US005484125A

United States Patent [19]

Anoszko

[11] Patent Number: 5,484,125

[45] Date of Patent: Jan. 16, 1996

[54] APPLIANCE MOUNTING SYSTEM

[75] Inventor: Thomas J. Anoszko, Oregon, Wis.

[73] Assignee: Research Products Corporation, Madison, Wis.

[21] Appl. No.: 55,229

[22] Filed: Apr. 28, 1993

[51] Int. Cl.[6] ..... A47H 1/10

[52] U.S. Cl. ..... 248/201; 248/317; 248/320

[58] Field of Search ..... 248/201, 202.1, 248/214, 215, 220.2, 222.1, 222.2, 225.1, 291, 317, 320, 321, 322, 323, 324, 339, 340, 341, 342

[56] References Cited

U.S. PATENT DOCUMENTS

| | | | |
|---|---|---|---|
| 2,662,988 | 12/1953 | McKim | 248/346 X |
| 3,182,946 | 5/1965 | Dudko | 248/291 |
| 3,521,225 | 7/1970 | Kursman et al. | 248/291 X |
| 4,540,146 | 9/1985 | Basile et al. | 248/201 |
| 4,580,853 | 4/1986 | Hitzeroth et al. | 248/317 X |
| 4,630,532 | 12/1986 | Sonnentag et al. | 248/201 X |
| 4,663,849 | 5/1987 | Nickelson | 248/324 X |
| 4,666,113 | 5/1987 | Itoh et al. | 248/317 X |
| 4,699,437 | 10/1987 | Generaux | 248/202.1 |
| 5,022,649 | 6/1991 | Traub et al. | 248/222.1 X |
| 5,039,902 | 8/1991 | Schwarz | 248/320 X |
| 5,131,620 | 7/1992 | Boundy et al. | 248/317 X |
| 5,149,039 | 9/1992 | Peterson et al. | 248/300 |

*Primary Examiner*—Alvin C. Chin-Shue
*Assistant Examiner*—Derek J. Berger
*Attorney, Agent, or Firm*—Andrus, Sceales, Starke & Sawall

[57] ABSTRACT

A mounting system for suspending an appliance from a supporting structure includes an elongated U-shaped bracket and a plurality of fasteners for securing the bracket to a supporting structure. A mounting pin is disposed toward one end of the bracket and a mounting hook is disposed toward one end of the appliance so that the hook may be placed over the mounting pin and the appliance can be pivotally suspended from the bracket. A locking means is provided toward one end of the appliance so that the appliance may be pivoted about the mounting pin and locked onto the bracket.

2 Claims, 2 Drawing Sheets

FIG. 3
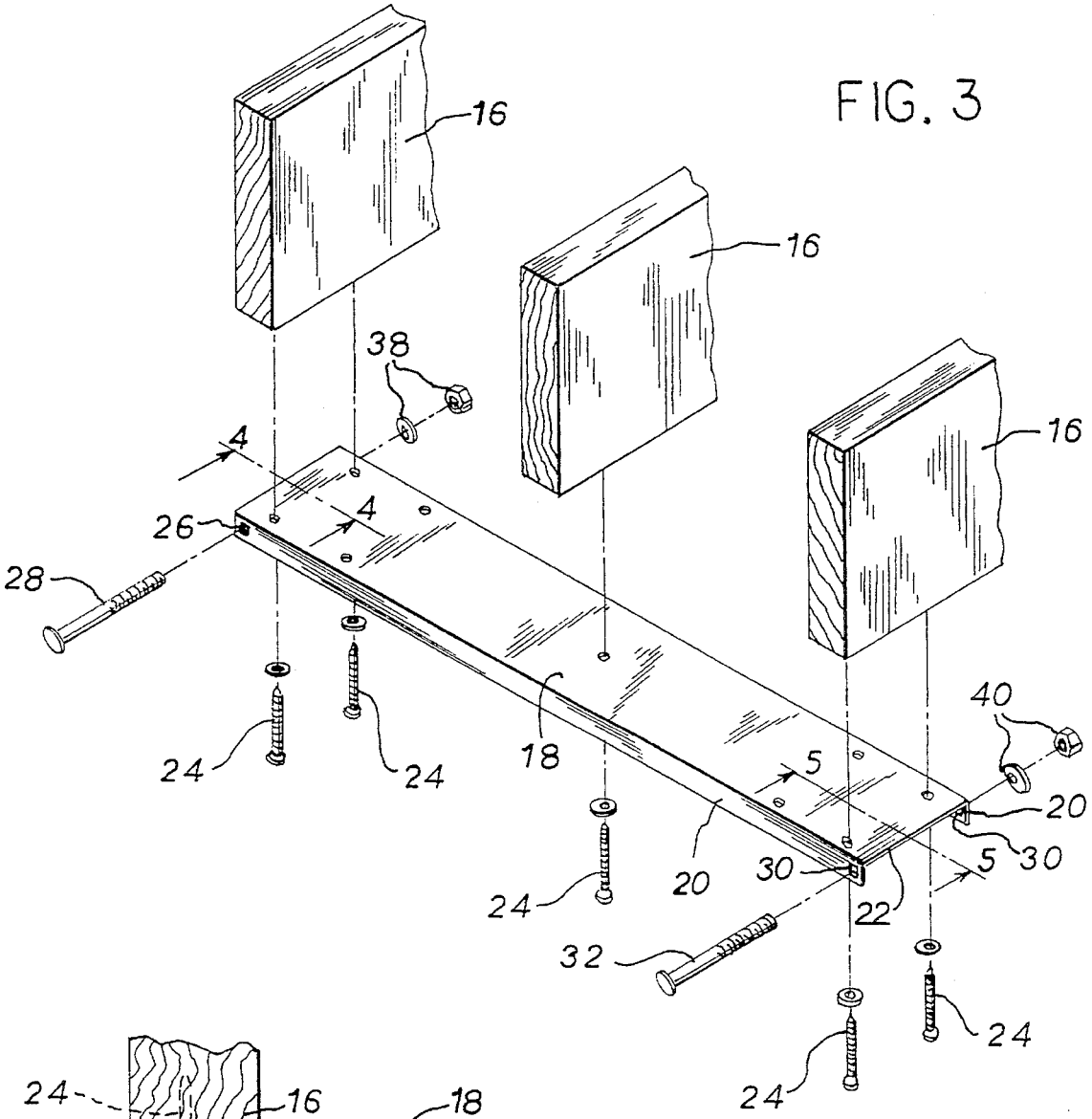
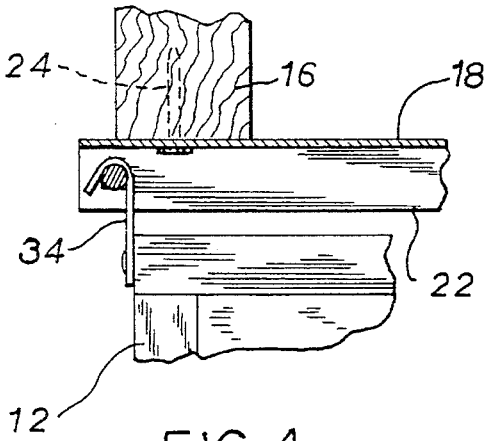
FIG.4
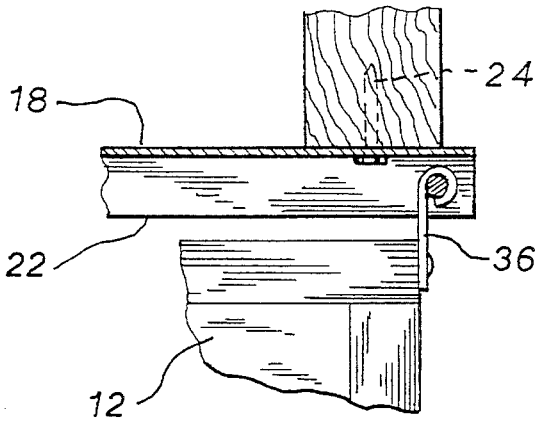
FIG 5

APPLIANCE MOUNTING SYSTEM

BACKGROUND OF THE INVENTION

The present invention relates to a mounting system for an appliance and more specifically to a mounting system for suspending a heat recovery ventilation system from a support structure.

Heat recovery ventilation systems are typically used in conjunction with the central heating system of a dwelling and as such are typically mounted near the ductwork of the furnace and more specifically are usually mounted to either the wall or the ceiling joist in that vicinity. In the past, the installation and/or mounting of the heat recovery ventilation system was a two man operation. The unit was typically secured by strapping or bolting the unit to brackets or the wall or ceiling itself. Since the unit is rather large and cumbersome, it was necessary for one man to lift and hold the unit in position while the other performed the fastening steps.

It is an object of the present invention to provide a simple appliance mounting system that makes it possible for one man to install and secure a cumbersome appliance such as a heat recovery ventilation unit.

SUMMARY OF THE INVENTION

A mounting system for suspending an appliance from a supporting structure includes an elongated U-shaped bracket and means for securing the bracket to the supporting structure.

In accordance with one aspect of the invention, a mounting pin is disposed toward one end of the bracket and a mounting hook is disposed toward one end of the appliance so that the hook may be placed over the mounting pin and the appliance can be pivotally suspended from the bracket.

In accordance with another aspect of the invention, locking means are disposed toward the other end of the appliance so that the appliance be pivoted about the mounting pin and locked onto the bracket.

The present invention thus provides a simple mounting system that allows a cumbersome appliance such a heat recovery ventilation unit to be initially lifted and hung from a bracket and then swung into a locking position, thus allowing for "one man installation".

BRIEF DESCRIPTION OF THE DRAWINGS

The drawings illustrate the best mode presently contemplated of carrying out the invention.

In the drawings:

FIG. 3 is an exploded view of the mounting bracket of the mounting system of FIG. 1;

FIG. 4 is a sectional view along the line 4—4 of FIG. 3; and

FIG. 5 is a sectional view along the line 5—5 of FIG. 3.

DETAILED DESCRIPTION OF THE PREFERRED EMBODIMENT

Figure 1:
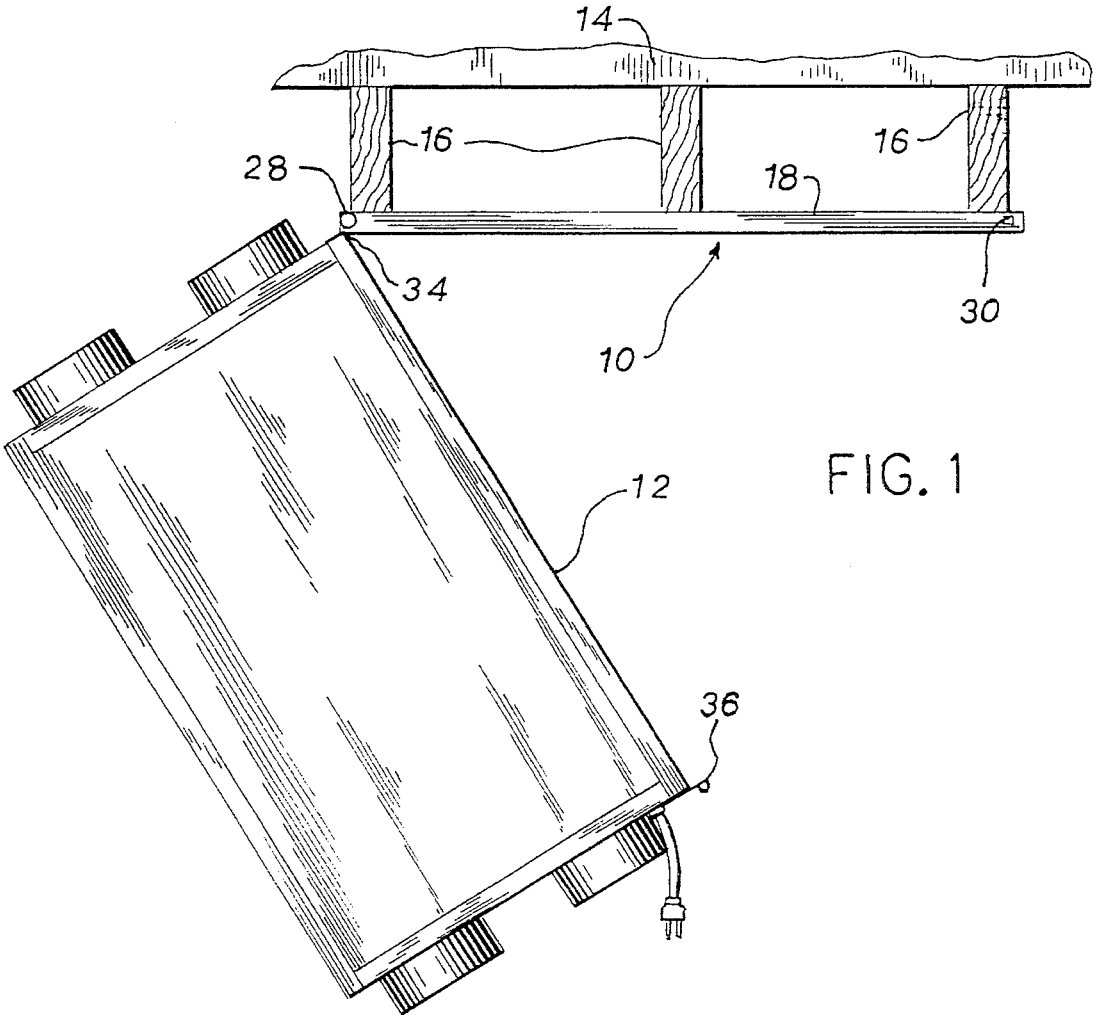
FIG. 1 is a side view of an appliance partially mounted with the mounting system of the present invention.
Figure 2:
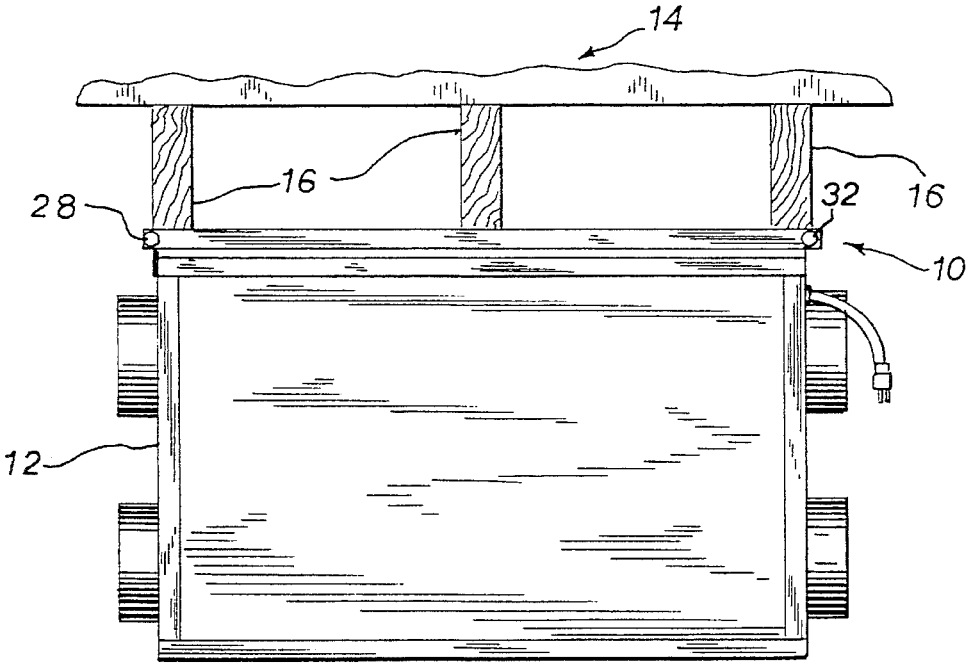
FIG. 2 is a side view of an appliance fully mounted using the system of FIG. 1.

FIGS. 1–5 illustrate a mounting system 10 for suspending an appliance 12 from a supporting structure 14. In this instance, appliance 12 is a heat recovery ventilation unit having a line or dimension and supporting structure 14 is comprised of a series of ceiling joists 16. While the drawings illustrate heat recovery ventilation unit 12 being suspended from an elevated horizontal surface, it should be appreciated that mounting system 10 can also be utilized with a vertical mounting surface such as a wall.

As seen in FIG. 3, mounting system 10 includes an elongated U-shaped bracket 18 having legs 20 that define a channel 22. Bracket 18 is secured to ceiling joist 16 by a plurality of threaded fasteners 24 and legs 20 are provided with a pair of aligned openings 26 at one end of bracket 18 that accept a threaded mounting pin 28. Similarly, legs 20 are provided with aligned openings 30 at the other end of bracket 18 which accept a threaded locking pin 32. The remaining elements of mounting system 10 include a mounting hook 34 disposed at one end of appliance 12 and dimensioned to fit over locking pin 28 and a locking sleeve 36 disposed at the other end of appliance 12 and dimensioned so as to fit within channel 22.

In order to mount appliance 12, an installer first secures mounting bracket 18 to the supporting structure by means of fasteners 24. Mounting pin 28 is then inserted through holes 26 in bracket 18 and secured in place by nut and washer combination 38. The installer than lifts appliance 12 and positions hook 34 over pin 28 so that appliance 12 is pivotally suspended from mounting pin 28 (FIG. 1). The installer then pivots appliance 12 upwardly so that the opening in sleeve 36 aligns with openings 30 in bracket 18. Threaded locking pin 32 is then inserted through holes 30 and sleeve 36 and secured in place by nut and washer combination 40.

The prevent invention thus provides a mounting system that permits one man to pivotally hang an appliance from the mounting system and then swing the appliance into a locking position and secure it in that position.

Various modes of carrying out the invention are contemplated as being within the scope of the following claims particularly pointing out and distinctly claiming the subject matter regarded as the invention.

I claim:

1. A mounting system for allowing one man installation and removal of an appliance from a supporting structure, said system comprising:

an assembled appliance having a linear dimension and a manipulable weight;

an elongated, U-shaped bracket connected to said supporting structure and having legs formed of continuous walls extending away from said supporting structure, said legs defining a channel therebetween and including openings formed therein surrounded by said walls, said bracket having a pivot end and a locking end;

a mounting pin disposed at said pivot end of said bracket for exclusively suspending said assembled appliance and extending through a first set of said surrounded openings in said legs of said bracket and across said channel, said mounting pin comprising a first elongated fastener having a first, singular retaining member on one end thereof;

a mounting hook disposed towards one end of said appliance and extending outwardly from a surface of said appliance, said appliance being pivotally suspended from said mounting pin and said bracket;

a locking sleeve disposed at said locking end of said bracket for locking said assembled appliance in a raised position, said locking sleeve dimensioned to fit within said channel; and a locking pin disposed at said locking end of said bracket for exclusively suspending said assembled appliance, said locking pin disposed within said sleeve and extending through a second set of surrounded openings formed in said legs of said bracket and extending across said channel, said locking pin comprising a second elongated fastener having a second, singular retaining member on one end thereof;

said assembled appliance being pivotally supportable about said mounting pin and lockable in said raised position by said locking pin, the weight of said assembled appliance being completely supported at both said pivot end and said locking end by said first and second elongated fasteners and said first and second singular retaining members;

said assembled appliance being installable and removable by respective tightening and loosening of said first and second singular retaining members.

2. A method for enabling one man installation and removal of an appliance from a supporting structure, the method comprising the steps of:

providing an assembled appliance having a linear dimension and a manipulable weight, said assembled appliance carrying a mounting hook extending outwardly at one thereof;

connecting a U-shaped bracket to the supporting structure, said bracket having legs formed of continuous walls extending away from the supporting structure, said legs defining a channel therebetween and including openings formed therein surrounded by said walls, said bracket having a pivot end and a locking end;

passing a mounting pin through a first set of said surrounded openings in said legs of said bracket at said pivot end thereof and across said channel;

securing said mounting pin in position by placing a first singular retaining member on one portion of said mounting pin;

providing a locking sleeve dimensioned to fit within said channel and adapted to be disposed at said locking end of said bracket;

lifting said assembled appliance and positioning said mounting hook over said mounting pin so that said assembled appliance is pivotally suspended from said mounting pin;

pivoting said assembled appliance upwardly such that the opening in said locking sleeve aligns with a second set of said surrounded openings in said legs of said bracket at said locking end thereof;

passing a locking pin through said second set of surrounded openings and said locking sleeve; and securing said locking pin in position by placing a second singular retaining member on one portion of said locking pin such that said assembled appliance is locked in raised position from said supporting structure;

whereby said assembled appliance is installable and removable by one man tightening and loosening said first and second singular retaining members.

* * * * *